US005310430A

United States Patent [19]

McCall, Jr.

[11] Patent Number: 5,310,430

[45] Date of Patent: May 10, 1994

[54] PROCESS OF DISPENSING A SOLID CAST BLOCK OF WATER SOLUBLE DETERGENT

[75] Inventor: John E. McCall, Jr., West Saint Paul, Minn.

[73] Assignee: Ecolab Inc., St. Paul, Minn.

[21] Appl. No.: 708,510

[22] Filed: May 31, 1991

[51] Int. Cl.[5] ..... B08B 7/00; B08B 3/04; C11D 17/00

[52] U.S. Cl. ..... 134/33; 134/93; 137/268; 252/90; 252/134; 252/174; 366/137

[58] Field of Search ..... 422/263, 264, 269, 271, 422/281; 134/93, 33; 252/90, 92, 134, DIG. 16, 174; 366/137, 167; 137/268

[56] References Cited

U.S. PATENT DOCUMENTS

| | | | |
|---|---|---|---|
| 32,763 | 10/1988 | Fernholz et al. | 252/90 |
| 32,818 | 1/1989 | Fernholz et al. | 252/90 |
| 235,730 | 12/1880 | Borie | 252/134 |
| 2,505,444 | 4/1950 | Verbsky | 252/92 |
| 2,604,386 | 7/1952 | Arant | 23/309 |
| 2,708,807 | 5/1955 | Smith | 252/174 |
| 3,341,897 | 5/1965 | Susuki et al. | 18/42 |
| 3,343,593 | 10/1965 | Goton et al. | 164/273 |
| 3,387,333 | 6/1968 | Irvine et al. | 18/35 |
| 3,649,545 | 3/1972 | Susuki et al. | 252/174 |
| 3,671,438 | 6/1972 | Cilia | 252/174 |
| 3,832,437 | 8/1974 | Taylor | 264/248 |
| 3,969,256 | 7/1976 | Hadley et al. | 252/174 |
| 4,126,291 | 11/1978 | Gilbert et al. | 249/63 |
| 4,151,243 | 4/1979 | Allen | 264/219 |
| 4,212,623 | 7/1980 | Allen | 425/547 |
| 4,238,106 | 12/1980 | Willingham | 249/79 |
| 4,362,291 | 12/1982 | Fuke et al. | 429/144 |
| 4,438,010 | 3/1984 | Lindauer et al. | 252/91 |
| 4,453,909 | 6/1984 | Lindauer et al. | 252/92 |
| 4,469,613 | 9/1984 | Munteanu et al. | 252/92 |
| 4,563,145 | 1/1986 | de Meij | 425/174.8 R |
| 4,569,780 | 2/1986 | Fernholz et al. | 252/90 |
| 4,569,781 | 2/1986 | Fernholz et al. | 252/90 |
| 4,744,849 | 5/1988 | Michaud-Soret | 156/245 |
| 4,795,126 | 1/1989 | Crandell | 249/78 |
| 4,826,661 | 5/1989 | Copeland et al. | 422/106 |

FOREIGN PATENT DOCUMENTS

| | | | |
|---|---|---|---|
| 0242966 | 10/1987 | European Pat. Off. . | |
| 847650 | 8/1952 | Fed. Rep. of Germany | 252/134 |
| 2084500 | 3/1990 | Japan . | |
| WO89/11753 | 11/1989 | PCT Int'l Appl. . | |
| 687075 | 2/1953 | United Kingdom | 252/174 |

OTHER PUBLICATIONS

Abstract of Japanese Patent Publication 62-36500.

*Primary Examiner*—Michael Lewis
*Assistant Examiner*—Stephen G. Kalinchak
*Attorney, Agent, or Firm*—Merchant, Gould, Smith, Edell, Welter & Schmidt

[57] ABSTRACT

A solid cast block of water soluble detergent is dispensed by obtaining a solid detergent article of at least twenty liters cast onto a longitudinally extending structural core and placing the article within the spray chamber of a dispenser such that the article is supported on the structural core. The detergent article is then rotated upon the structural core while dissolving solvent is sprayed upon the rotating article. The resulting detergent solution is dispensed to an end use point.

7 Claims, 5 Drawing Sheets

FIG. 5
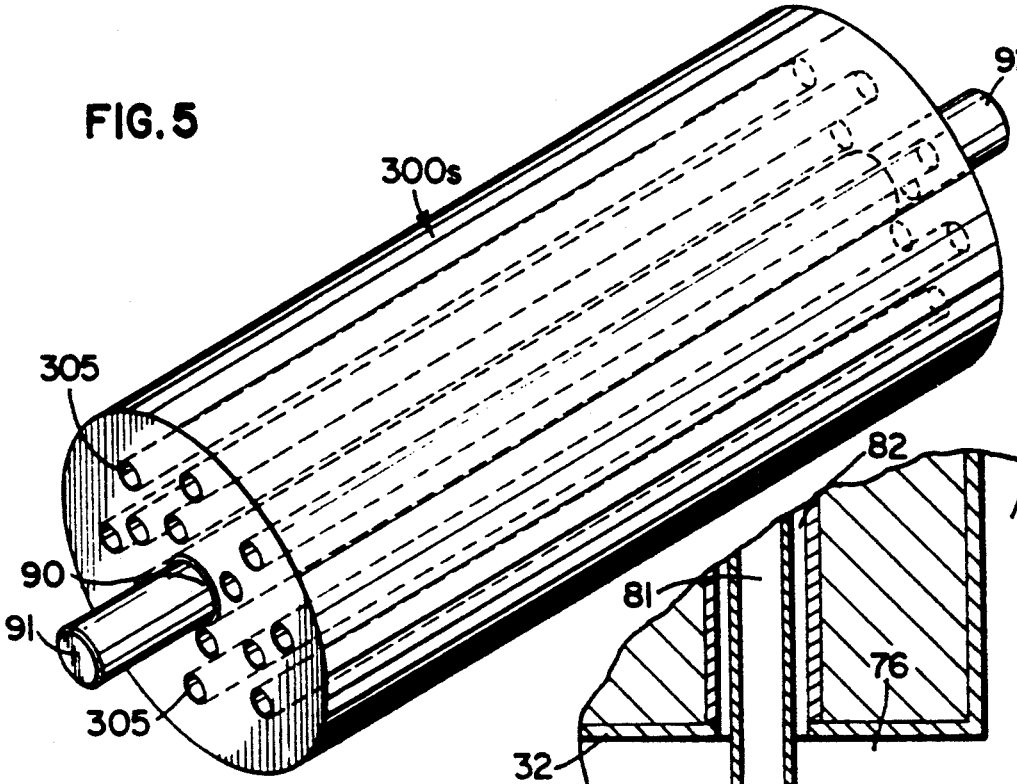
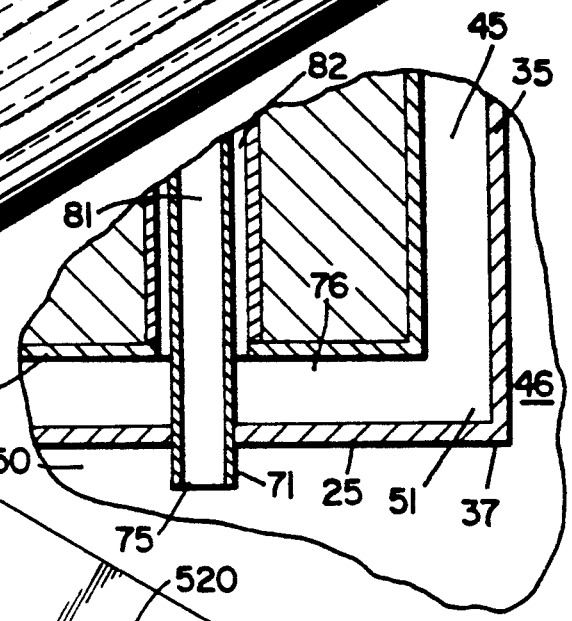
FIG. 4
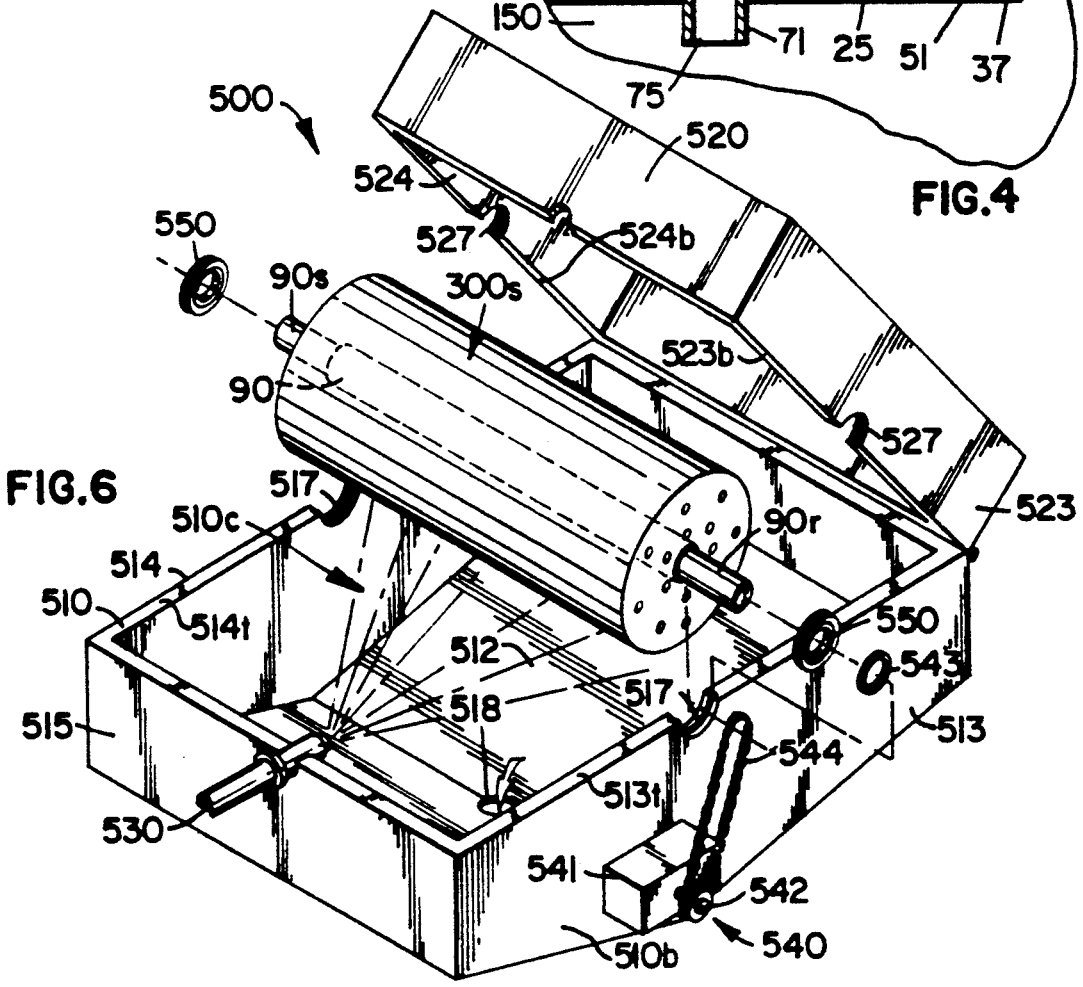
FIG. 6

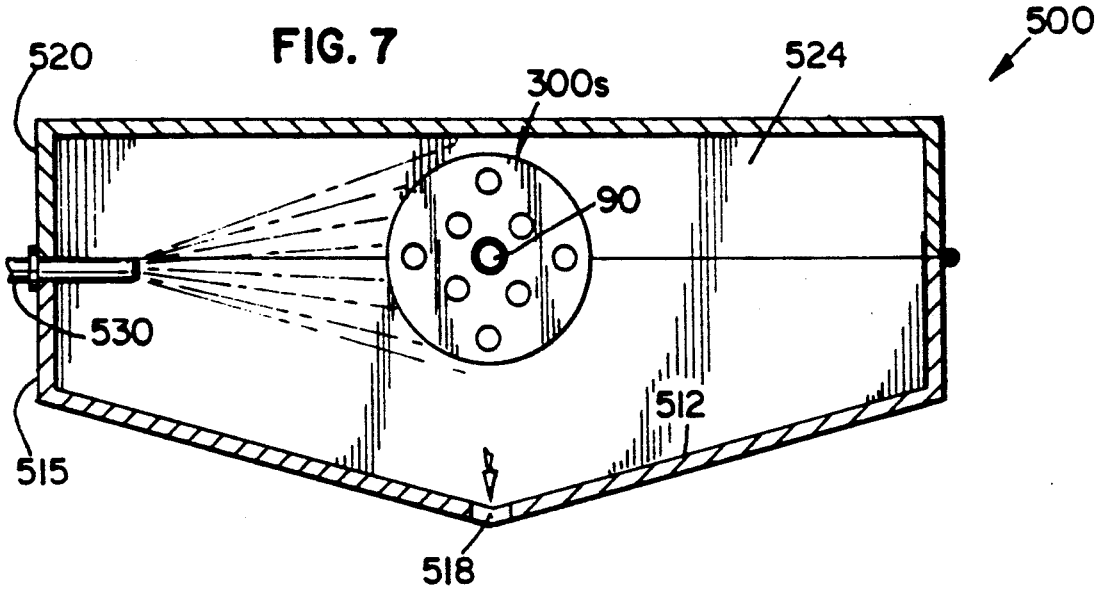
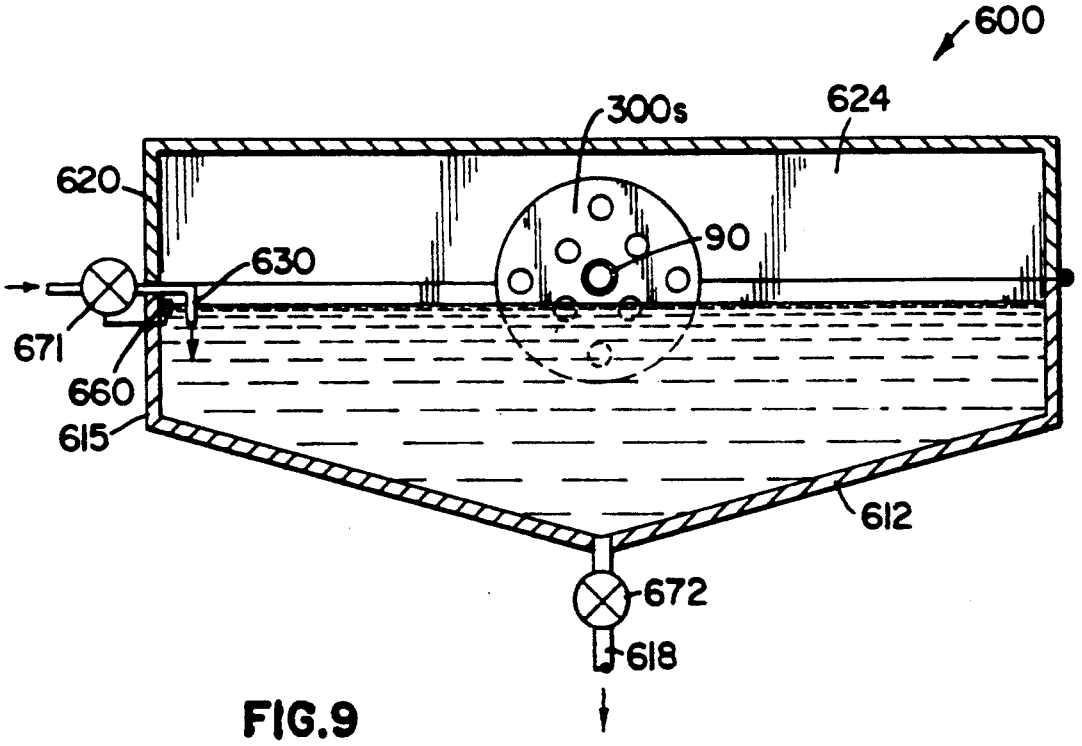
FIG.9

PROCESS OF DISPENSING A SOLID CAST BLOCK OF WATER SOLUBLE DETERGENT

FIELD OF THE INVENTION

Broadly, the invention relates to the casting of molten detergent compositions. Specifically, the invention relates to the casting of oversized blocks of molten detergent compositions.

BACKGROUND

The advent of solid cast detergent compositions has revolutionized the manner in which detergents are used and dispensed by those commercial and institutional entities which routinely use large quantities of cleaning solution. Prior to the advent of solid cast detergents, detergents were available in liquid, granular or pellet form. The solid cast form, such as those disclosed in Re. U.S. Pat. No. 32,763, Re. U.S. Pat. No. 32,818, U.S. Pat. Nos. 4,680,134 and 4,595,520, offered numerous unique advantages and quickly replaced a major portion of the conventional liquid, granular and pellet forms in the commercial and institutional markets.

The unique advantages offered by the solid cast forms of detergent include improved handling resulting in enhanced safety, elimination of component segregation during transportation and storage, increased concentration of active ingredients within the composition, and numerous others.

One method of manufacturing solid cast detergent compositions involves the steps of forming a homogenous melt of the various components, casting the molten melt into a mold, and solidifying the melt by cooling. For example, Fernholz et al., Reissue U.S. Pat. No. 32,763, describes a method of manufacturing a solid cast detergent composition which involves the steps of (i) forming an aqueous solution or dispersion of two hydratable chemicals, such as sodium hydroxide and sodium tripolyphosphate, (ii) heating the solution to a temperature of about 65° to 85° C. to form a heated solution, (iii) increasing the concentration of hydratable chemicals in the heated solution to produce a molten mixture which is liquid at the elevated temperature but solid at room temperature, and (iv) casting the molten mixture into molds for cooling and solidification to room temperature.

One difficulty encountered in the manufacture of solid cast detergent compositions by the molten process is the speed with which complete solidification of the cast composition can be achieved. It is understandably desirable to ensure that substantially the entire volume of a cast block of detergent composition is solid prior to effecting significant handling and/or transportation thereof in order to reduce the possibility that any remaining molten portion of the composition could be released and result in property damage and/or personal injury.

Generally, cast molten detergent compositions tend to cool and solidify from the exposed outer surfaces inward such that an outer crust usually forms on the cast detergent composition while the inner volume remains molten. This outer crust then tends to act as a insulating barrier and slows cooling of the remaining molten detergent composition. Because of this phenomena, it is generally accepted that, even though certain commercial and institutional users could benefit by using oversized blocks of solid cast detergent composition, the size of solid cast blocks of detergent composition formed by the molten process must be maintained below about 20 liters in order to prevent unreasonable delay in effecting complete solidification of the cast material.

In addition, the performance of solid cast detergent compositions is generally enhanced by the inclusion of one or more heat sensitive components such as tripolyphosphate detergent builders, chlorine bleaches, and enzymes. These heat sensitive components can be significantly degraded by extended exposure to the molten detergent composition.

Another drawback encountered in the manufacture of solid cast detergent compositions by the molten process is the need to employ a returnable/disposable mold within which the detergent may be cast, stored, transported, and dispensed. Disposable molds contribute to the growing problem of solid waste control while returnable molds are expensive to manufacture and cumbersome to handle.

Accordingly, a substantial need exists for a simple and relatively inexpensive process for producing oversized blocks of detergent compositions by the molten process which minimizes cooling time, reduces degradation of heat sensitive components, eliminates the need for environmentally harmful disposable receptacles and cumbersome returnable containers, and provides a generous exposed surface area available for dissolution by a dissolving fluid during dispensing.

SUMMARY OF THE INVENTION

I have discovered a simple and efficient process for casting large blocks of molten detergent composition. The process employs a mold with a plurality of longitudinally extending linear heat exchange tubes dispersed within the casting chamber and includes the steps of: pouring molten detergent composition into the casting chamber; solidifying substantially the entire volume of molten detergent composition within the casting chamber by removing heat from the detergent composition through the heat exchange tubes; heating the heat exchange tubes so as to melt an effective releasing amount of the solidified detergent composition proximate the heat exchange tubes and thereby permit the solid cast block of detergent to be withdrawn from the casting chamber as a single unit; and removing the solid cast block of detergent from the mold as a single unit.

BRIEF DESCRIPTION OF THE DRAWINGS

FIG. 4 is an enlarged cross-sectional view of a portion of the mold of FIG. 3.

FIG. 5 is a perspective view of one embodiment of a bulk block of a solid cast detergent composition manufactured in accordance with the invention.

FIG. 6 is perspective view of a spray-type dispenser useful in dispensing the bulk block of solid cast detergent composition manufactured in accordance with the invention including a block of detergent composition.

FIG. 7 is a cross-sectional side-view of the dispenser of FIG. 6.

FIG. 9 is a cross-sectional side-view of the submersion-type dispenser of FIG. 8.

DETAILED DESCRIPTION OF THE INVENTION INCLUDING A BEST MODE

Mold

Nomenclature

Figure 1:
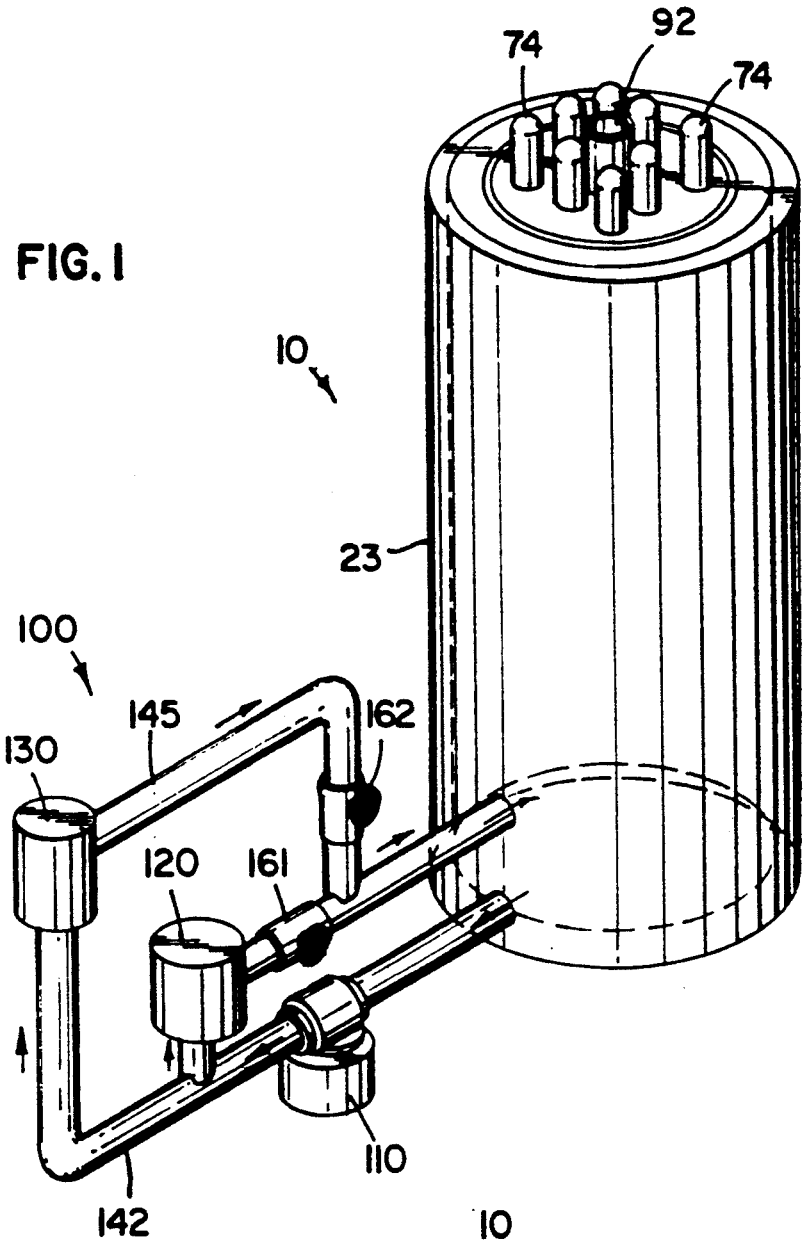
FIG. 1 is a perspective view of one embodiment of a casting system useful in the process of the invention which includes molten detergent composition within the casting chamber.

001 casting system
10 mold
20 vessel
21 top of vessel
22 base of vessel
23 sidewall of vessel/exterior sidewall
25 horizontal dividing plate
26 central orifice through dividing plate
27 collar
28 O-ring seal
29 receptacle
30 central casting chamber
31 top of casting chamber
32 base of casting chamber/interior base plate
33 sidewall of casting chamber/interior sidewall
34 central orifice through interior base plate
35 baffle
36 top of baffle
37 bottom of baffle
40 annular encircling cavity
41 inner portion of encircling cavity
42 outer portion of encircling cavity
43 top of inner portion of encircling cavity
44 top of outer portion of encircling cavity
45 bottom of inner portion of encircling cavity
46 bottom of outer portion of encircling cavity
50 distribution chamber
51 periphery of distribution chamber
55 inlet
60 reservoir
65 outlet
70 heat exchange tubes
71 inner pipe
72 outer pipe
73 top of inner pipe
74 top of outer pipe
75 bottom of inner pipe
76 bottom of outer pipe
81 bore through inner pipe
82 annular cavity between inner and outer pipes
90 central shaft
91 first end of central shaft
92 second end of central shaft
100 heat exchange system
110 pump
120 heating unit
130 refrigeration unit
141 first length of conduit
142 second length of conduit
143 third length of conduit
144 fourth length of conduit
145 fifth length of conduit
151 junction point of second and third conduits
152 junction point of fourth and fifth
161 first valve
162 second valve
200 heat exchange fluid
300 detergent composition
**300*m*** molten body of detergent composition
**300*s*** solid cast block of detergent composition

CONSTRUCTION

The casting system 001 of the invention includes a mold 10 for casting a detergent composition 300 and a heat exchange system 100 in fluid communication with the mold 10 for selectively heating/cooling the detergent composition 300 cast within the mold 10. The casting system 001 provides for rapid solidification of an oversized mass of molten detergent composition **300*m* cast within the mold 10 and subsequent substantially effortless removal of the solid cast block of detergent composition 300*s* from the mold 10**.

The principal component of the mold 10 is a vessel 20 which defines a cylindrical cavity (unnumbered) accessible through an open top 21. The cylindrical cavity (unnumbered) is separated by a horizontal dividing plate 25 into upper (unnumbered) and lower (unnumbered) chambers. The upper chamber (unnumbered) is partitioned into a central cylindrical casting chamber 30, an annular encircling cavity 40 surrounding the casting chamber 30, and a cylindrical distribution chamber 50 immediately below the casting chamber 30 and annular encircling cavity 40. The casting chamber 30 is defined by an interior sidewall 33 and an interior base plate 32. The annular encircling cavity 40 is defined by the interior sidewall 33 and the sidewall 23 of the vessel 20. The distribution chamber 50 is defined by the interior base plate 32 and the horizontal dividing plate 25.

The annular encircling cavity 40 is further divided by a cylindrical baffle 35 into an inner annular portion 41 and an outer annular portion 42. The top 36 of the baffle 35 is spaced from the top 21 of the vessel 20 so as to place the top 43 of the inner portion 41 of the annular encircling cavity 40 in fluid communication with the top 44 of the outer portion 42 of the annular encircling cavity 40. The bottom 37 of the baffle 35 is mounted to the horizontal dividing plate 25 so as to prevent fluid flow directly from the distribution chamber 50 to the outer portion 42 of the annular encircling cavity 40. Such a configuration provides that pressurized heat exchange fluid 200 directed into the distribution chamber 50 will flow up the inner portion 41 of the annular encircling cavity 40 where it is operable for adding/removing heat from a detergent composition 300 retained within the casting chamber 30, and then down the outer portion 42 of the annular encircling cavity 40 and into the reservoir 60.

Perforations (unnumbered) are provided through that peripheral portion of the horizontal dividing plate 25 in communication with the outer portion 42 of the annular encircling cavity 40 so as to provide fluid communication from the outer portion 42 of the annular encircling cavity 40 to the reservoir 60.

A plurality of heat exchange tubes 70 extend longitudinally into the casting chamber 30 from the interior base plate 32. The heat exchange tubes 70 include concentric inner 71 and outer 72 pipes. The top 74 of the outer pipe 72 is closed to prevent the introduction of heat exchange fluid 200 into the casting chamber 30 and prevent the introduction of molten detergent composition **300*m* into the heat exchange tubes 70. The top 73 of the inner pipe 71 is open and spaced from the enclosed top 74 of the outer pipe 72 so as to place the top (unnumbered) of the annular cavity 82 defined between the inner 71 and outer 72 pipes in fluid communication with the top (unnumbered) of the bore 81 extending through the inner pipe 71. The bottom 75 of the inner pipe 71 extends through the horizontal dividing plate 25 such that the bore 81 of the inner pipe 71 is placed in direct fluid communication with the reservoir 60. The bottom 76 of the outer pipe 72 is secured to the interior base plate 32 such that the annular cavity 82 is in direct fluid communication with the distribution chamber 50. As with the annular encircling cavity 40, such a configuration provides that pressurized heat exchange fluid 200 directed into the distribution chamber 50 will flow up the annular cavity 82 of each heat exchange tube 70 where it is operable for adding/removing heat from a detergent composition 300 retained within the casting chamber 30, and then down the bore 81 of the inner pipe 71 and into the reservoir 60**.

The height of the baffle 35 and the inner pipes 71 must be substantially the same so that heat exchange fluid 200 will flow under the force of gravity into both the outer annular portion 42 of the annular encircling cavity 40 and the bore 81 of the inner pipe 71 without favoring a particular flow path.

A central orifice 26 through the horizontal dividing plate 25 is longitudinally aligned with a central orifice 34 through the interior base plate 32 for accepting passage of a first end 91 of a longitudinally extending central shaft 90. A collar 27 connects the horizontal dividing plate 25 and the interior base plate 32 about the circumferences of the respective central orifices 26,34 for preventing fluid flow between the casting chamber 30 and the distribution chamber 50. A receptacle 29 is mounted to the horizontal dividing plate 25 immediately under the central orifice 26 in the horizontal dividing plate 25 for retaining the first end 91 of the central shaft 90 and preventing fluid flow between the casting chamber 30 and the reservoir 60. An O-ring 28 is provided within the collar 27 for sealingly contacting the central shaft 90 and reducing the flow of molten detergent composition 300*m* from the casting chamber 30 into the receptacle 29. The central shaft 90 is intended to be removed along with the solid cast block of detergent composition 300*s* for facilitating the handling, transportation and dispensing thereof. The central 90 would then be returned for reuse in casting another block of detergent composition 300*s*.

A heat exchange system 100 is in fluid communication with the distribution chamber 50 and reservoir 60 for selectively circulating a heat exchange fluid 200 from the reservoir 60 through a heating unit 120 or a refrigeration unit 130 and into the distribution chamber 50. The distribution chamber 50, reservoir 60, heating unit 120, and refrigeration unit 130 are interconnected by a series of conduits and valves. A first conduit 141 provides fluid communication between the outlet orifice 61 in the reservoir 60 and the downstream port of a pump 110. A second conduit 142 provides fluid communication between the upstream port of the pump 110 and the refrigeration unit 130. A third conduit 143 branches from the second conduit 142 at junction 151 for providing fluid communication between the upstream port of the pump 110 and the heating unit 120. A fourth conduit 144 provides fluid communication between the heating unit 120 and an inlet orifice 55 in the distribution chamber 50. A fifth conduit 145 branches from the fourth conduit 144 at junction 152 for providing fluid communication between the refrigeration unit 130 and the distribution chamber 50. First 161 and second 162 valves are located in the fourth 144 and fifth 145 conduits for permitting selective circulation through the heating 120 and refrigeration 130 units.

OPERATION

Figure 2:
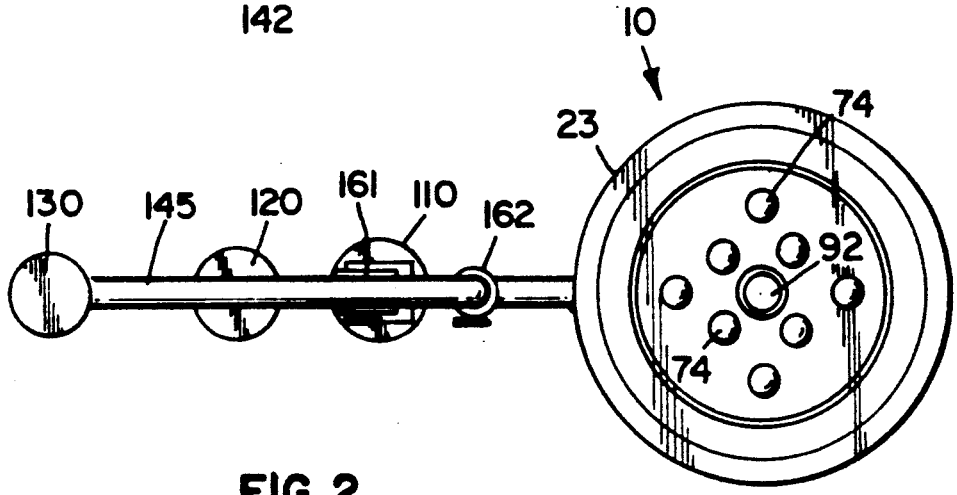
FIG. 2 is a top view of the mold of FIG. 1.
Figure 3:
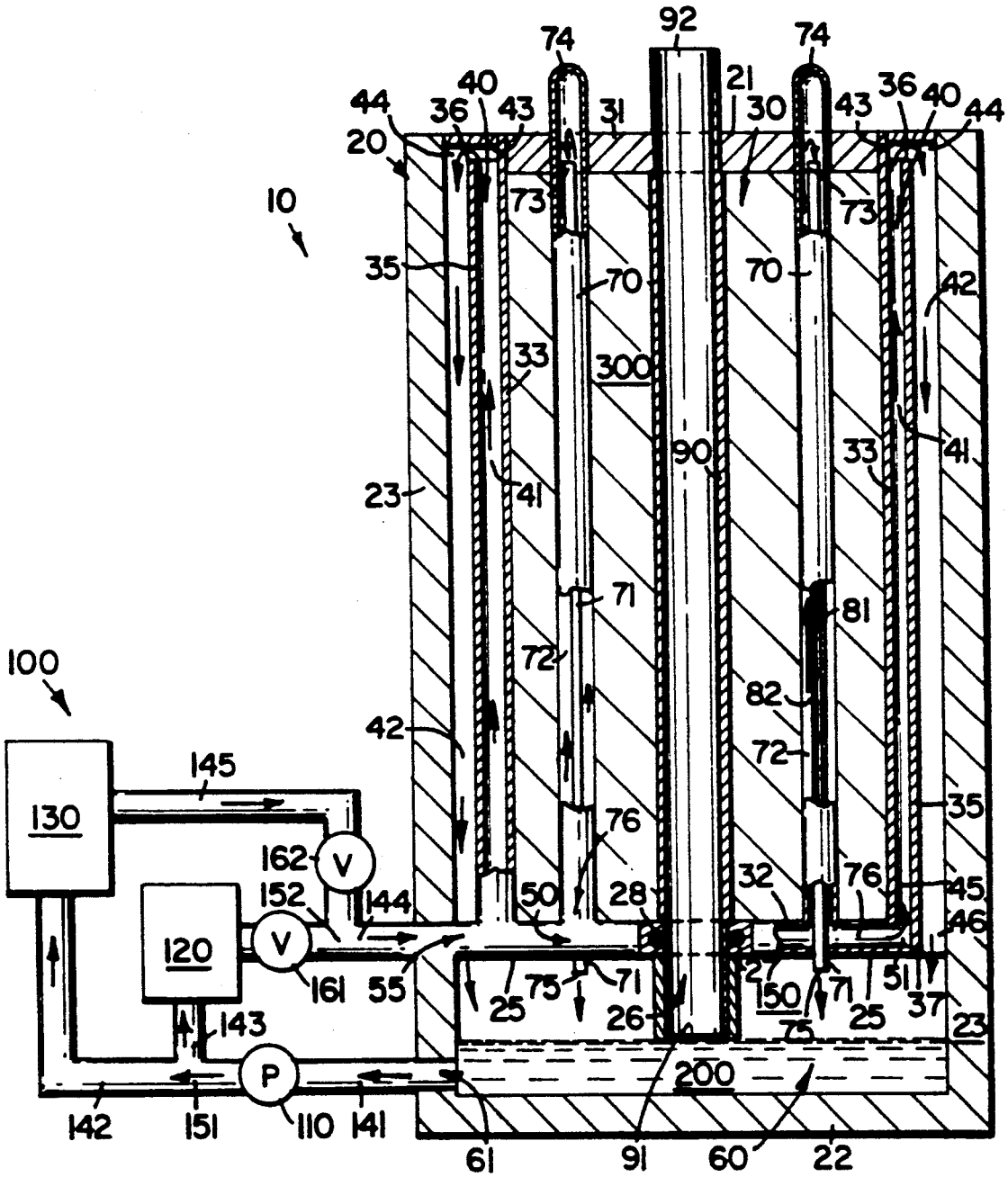
FIG. 3 is a cross-sectional side-view of the mold of FIG. 1.

An oversized solid block of detergent composition 300*s* may be quickly and efficiently cast within the mold 10 depicted in FIGS. 1-3 by (i) pouring a sufficient quantity of molten detergent composition 300*m* into the casting chamber 30, (ii) closing first valve 161 and opening second valve 162 so as to direct the flow of heat exchange fluid 200 through the refrigeration unit 130, (iii) initiating operation of pump 110 to circulate heat exchange fluid 200 through the heat exchange system 100 and mold 10, (iv) initiating operation of the refrigeration unit 130 to cool the heat exchange fluid 200 passing therethrough, and (v) continuing to circulate and cool the heat exchange fluid 200 until the cast molten detergent composition 300*m* has solidified through substantially the entire cross-sectional area thereof.

The solidified cast block of detergent composition 300*s* may be removed from the casting chamber 30 by (i) continuing operation of circulation pump 110, (ii) opening first valve 161 and closing second valve 162 so as to redirect the flow of heat exchange fluid 200 from the refrigeration unit 130 to the heating unit 120, (iii) initiating operation of the heating unit 120 to heat the heat exchange fluid 200 passing therethrough, (iv) continuing to circulate and heat the heat exchange fluid 200 until that layer of the solidified cast block of detergent composition 300*s* in direct contact with the casting chamber sidewall 33, casting chamber base 32, and heat exchange tubes 70 is liquefied, and then (v) pulling the solid cast block of detergent composition 300*s* out of the casting chamber 30 through the open top 21 of the vessel 20 using the central shaft 90.

The heat exchange fluid 200 is stored within reservoir 60 and pumped by pump 110 through the heat exchange system 100 and mold 10 for heating/cooling the detergent composition 300 within the casting chamber 30. Specifically, the heat exchange fluid 200 is pumped from the reservoir 60 through (i) the first length of conduit 141, (ii) alternatively through the refrigeration sequence of third length of conduit 143, refrigeration unit 130, and fourth length of conduit 144, or the heating sequence of second length of conduit 142, heating unit 120, and fifth length of conduit 145, (iii) into the distribution chamber 50, (iv) simultaneously up the outer annular cavities 82 in the heat exchange tubes 70 between the inner 71 and outer 72 pipes, and the inner portion 41 of the annular encircling cavity 40 between the sidewall 33 of the casting chamber 30 and the baffle 35, (v) simultaneously down the bore 81 of the inner pipes 71 in the heat exchange tubes 70, and the outer portion 42 of the annular encircling cavity 40 between the baffle 34 and the sidewall 23 of the vessel 20, and (vi) back into the storage reservoir 60.

Cast Block of Detergent Composition

Nomenclature

90 central shaft
91 first end of central shaft
92 second end of central shaft
300 detergent composition
300*s* solid cast block of detergent composition
305 longitudinal circular channels

Construction

Referring to FIG. 5, the oversized solid cast block of detergent composition 300*s* forms a right circular cylinder with a plurality of longitudinal circular channels 305 created by the tubular heat exchangers 70 extending through the solid cast block of detergent composition 300*s*. The longitudinal circular channels 305 should extend completely through the solid cast block of detergent composition 300*s* to provide uniform dissolution of the detergent composition 300 in a spray-type dispenser. Failure to extend the longitudinal circular channels 305 completely through the solid cast block of detergent composition 300*s* would result in the presence of more detergent composition 300 at that end of the block of detergent composition 300*s* which does not have longitudinal circular channels 305 extending therethrough. This presence of additional detergent composition 300 at one end would result in nonuniform dissolution of the solid cast block of detergent composition 300*s* across the length of the block of detergent composition 300*s* and create the potential for difficulties to be encountered in dispensing of the entire block of detergent composition 300*s* from the central shaft 90.

The central shaft 90 remains attached to the solid cast block of detergent composition 300*s* with a portion of each end 91,92 extending beyond the solid cast block of detergent composition 300*s* for facilitating handling, transportation and dispensing of the solid cast block of detergent composition 300*s*.

The constitution of the detergent/rinse aid composition is unrestricted other than the basic requirements that the composition be castable in molten form and function as a detergent or rinse aid composition. Many such detergent and rinse aid composition formulations are known including those described in Re. U.S. Pat. No. 32,763, Re. U.S. Pat. No. 32,818, U.S. Pat. Nos. 4,595,520, 4,624,713 and 4,680,134 assigned to Ecolab, Inc of St. Paul, Minn.

Dispenser

Nomenclature

500 spray-type dispenser
510 housing
510*c* dispensing chamber
512 bottom of housing
513 right side of housing
513*t* top edge of right side of housing
514 left side of housing
514*t* top edge of left side of housing
515 front of housing
517 semicircular notches in sides of housing
518 outlet orifice through bottom of housing
520 cover
523 right side of cover
523*b* bottom edge of right side of cover
524 left side of cover
524*b* bottom edge of left side of cover
527 semicircular notches in sides of cover
530 spray nozzle
540 rotational drive assembly
541 motor
542 first gear/drive gear
543 second gear/annular gear
544 chain
550 bushings
600 submersion-type dispenser
610 housing
610*c* dispensing chamber
612 bottom of housing
613 right side of housing
613*t* top edge of right side of housing
614 left side of housing
614*t* top edge of left side of housing
615 front of housing
617 semicircular notches in sides of housing
618 outlet pipe
620 cover
623 right side of cover
623*b* bottom edge of right side of cover
624 left side of cover
624*b* bottom edge of left side of cover
627 semicircular notches in sides of cover
630 inlet pipe
640 rotational drive assembly
641 motor
642 first gear/drive gear
643 second gear/annular gear
644 chain
650 bushings
660 level sensor
671 inlet valve
672 outlet valve

Construction

The solid cast block of detergent composition 300*s* may be dispensed using any number of various types of dispensers including submersion-type and spray-type dispensers. Briefly, the solid cast block of detergent composition 300*s* may be dispensed by either (i) submerging all or a portion of the solid cast block of detergent composition 300*s* in water to dissolve a portion of the detergent composition 300 and then directing the concentrated detergent solution to a point of use, or (ii) spraying an exposed surface of the solid cast block of detergent composition 300*s* with water and then immediately directing the concentrated detergent solution to either a storage tank or straight to a point of use.

The solid cast block of detergent composition 300*s* manufactured in accordance with the process of this invention has all surfaces exposed so as to provide a considerable contactable surface area and thereby permit quick and efficient dissolution and dispensing of the detergent composition.

Spray-Type

The solid cast block of detergent composition 300*s* may be conveniently dispensed using the spray-type dispenser 500 depicted in FIGS. 6 and 7. The basic function and design of spray-type dispensers is well known as indicated by the disclosure of U.S. Pat. Nos. 4,426,362, 4,571,327, 4,687,121, 4,690,305 and 4,826,661.

The spray-type dispenser 500 depicted in FIGS. 6 and 7 includes a housing 510 defining a dispensing chamber 510*c* for retaining an oversized solid cast block of detergent composition 300*s*. A cover 520 is hingedly connected to the housing 510 to permit complete enclosure of the solid cast block of detergent composition 300*s* during dispensing while providing access to the dispensing chamber 510*c* for loading of solid cast blocks of detergent composition 300*s*. The top 513*t* of the right side 513 and top 514*t* of the left side 514 of the housing 510 include laterally aligned semicircular notches 517 for retentatively accepting bushings 550 which have been placed onto the exposed ends 91,92 of the central shaft 90 on a solid cast block of detergent composition 300*s*. The bottom 523*b* of the right side 523 and bottom 524*b* of the left side 524 of the cover 511 include semicircular notches 527 which coincide with the notches 517 in the right 513 and left 514 sides of the housing 510 for providing a complete encircling of the bushings 550 and permitting the cover 511 to close completely while the ends 91,92 of the central shaft 90 on a solid cast block of detergent composition 300*s* retained within the dispensing chamber 510*c* extend from the sides 513,514 of the housing 510.

A spray nozzle 530 extends through the front 515 of the housing 510 for providing a spray of a dissolving solvent against the forward facing surface of the solid cast block of detergent composition 300*s*. The spray dissolves a portion of the detergent composition 300 and forms a concentrated detergent solution which is directed by the sloped bottom 512 of the housing 510 to an outlet orifice 518 from where it may be directed as desired.

Because only the forward facing surface of the solid cast block of detergent composition 300*s* is contacted and dissolved by the water spray, the solid cast block of detergent composition 300*s* should be rotated about the central shaft 90 to provide uniform dissolution. A means for rotating the solid cast block of detergent composition 300*s* is mounted on the right side 513 of the housing 510. The rotational drive assembly 540 includes a motor 541, a first gear 542 mounted onto the drive shaft (unnumbered) of the motor 541, a second gear 543 fixedly attached to the first end 91 of the central shaft 90, and a chain 544 interconnecting the first 542 and second 543 gears. The speed with which the solid cast block of detergent composition 300*s* should be rotated depends upon several factors such as the amount of detergent composition 300 required and the dissolution rate of the detergent composition 300. Accordingly, the rotational speed should be determined on a case by case basis by simply monitoring the speed with which the detergent composition 300 is dissolved and rotating the block of detergent composition 300*s* to prevent excessive dissolution from any particular portion. Any of a number of appropriate means may be employed to provide the desired rotational rate including motor selection and use of a suitable gear ratio as between the first 542 and second 543 gears. In addition, the solid cast block of detergent composition 300*s* need only be rotated when the solid cast block of detergent composition 300*s* is being sprayed with water. Again, any of a number of appropriate means may be employed to provide the desired rotational timing including interconnection of the start/stop buttons (not shown) which control operation of the valve (not shown) regulating water flow to the spray nozzle 530 and operation of the motor 541 effecting rotation of the solid cast block of detergent composition 300*s*.

Submersion-Type

Figure 8:
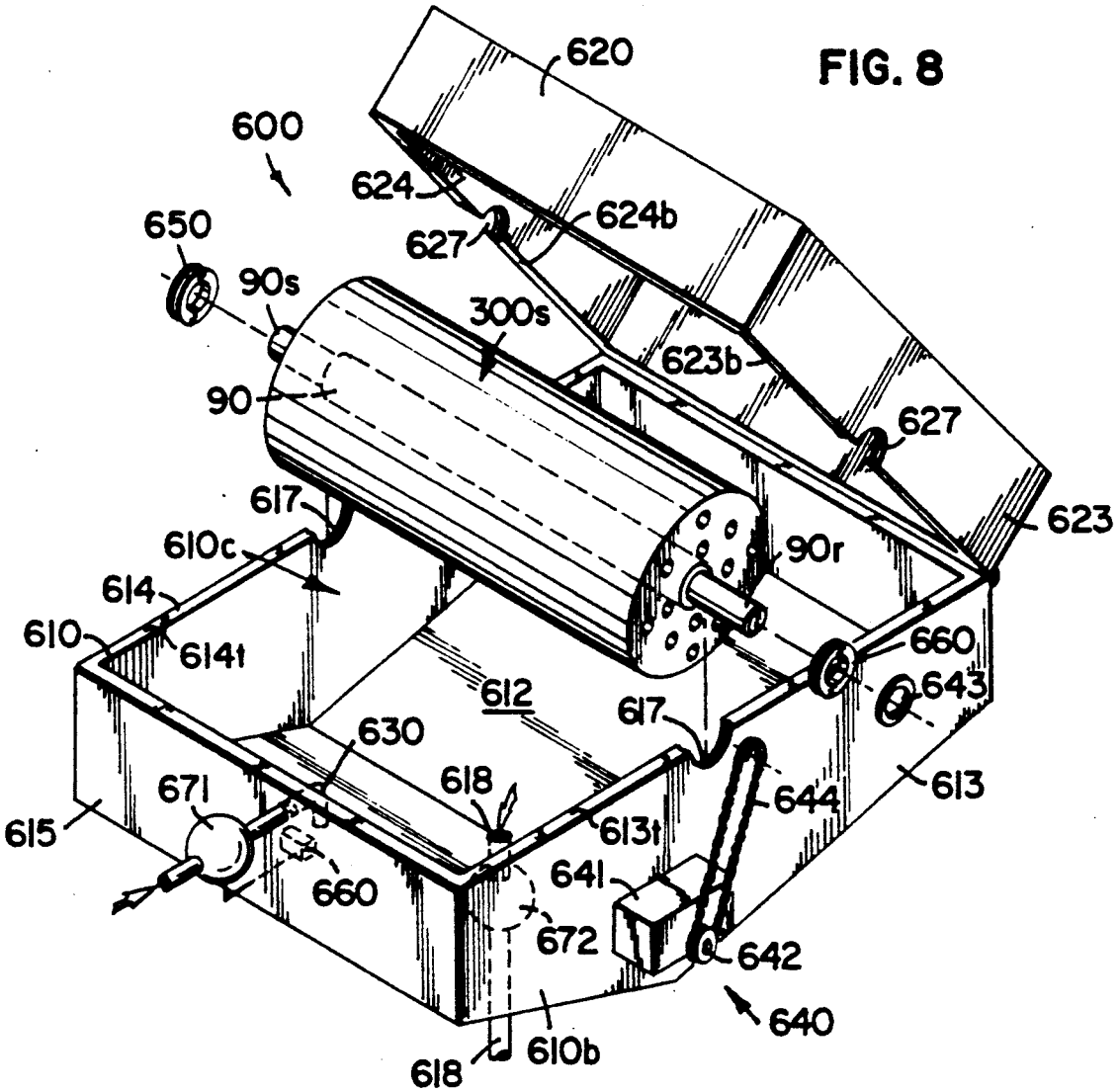
FIG. 8 is perspective view of a submersion-type dispenser useful in dispensing the bulk block of solid cast detergent composition manufactured in accordance with the invention including a block of detergent composition.

Alternatively, the solid cast block of detergent composition 300*s* may be conveniently dispensed using the submersion-type dispenser 600 depicted in FIG. 8. The basic function and design of submersion-type dispensers is well known as indicated by the disclosure of U.S. Pat. Nos. 1,949,264, 2,370,609, 2,477,998, 2,604,386, and 3,273,586.

The structure of the submersion-type dispenser 600 depicted in FIG. 8 is similar to the structure of the spray-type dispenser 500 of FIGS. 6 and 7 and includes a housing 610 defining a dispensing chamber 610*c* for retaining an oversized solid cast block of detergent composition 300*s*. A cover 620 is hingedly connected to the housing 610 to permit complete enclosure of the solid cast block of detergent composition 300*s* during dispensing while providing access to the dispensing chamber 610*c* for loading of solid cast blocks of detergent composition 300*s*. The top 613*t* of the right side 613 and top 614*t* of the left side 614 of the housing 610 include laterally aligned semicircular notches 617 for retentatively accepting bushings 650 which have been placed onto the exposed ends 91,92 of the central shaft 90 on a solid cast block of detergent composition 300*s*. The bottom 623*b* of the right side 623 and bottom 624*b* of the left side 624 of the cover 611 include semicircular notches 627 which coincide with the semicircular notches 617 in the right 613 and left 614 sides of the housing 610 for providing a complete encircling of the bushings 650 and permitting the cover 611 to close completely while the ends 91,92 of the central shaft 90 on a solid cast block of detergent composition 300*s* retained within the dispensing chamber 610*c* extend from the sides 613,614 of the housing 610.

An inlet pipe 630, which is in fluid communication with a source of pressurized water, extends through the front 615 of the housing 610 for filling the dispensing chamber 510*c* with sufficient water to submerse the lower portion of the solid block of detergent composition 300*s* and thereby form a concentrated detergent solution by dissolving a portion of the detergent composition 300. The level of water in the dispensing chamber 610*c* is controlled by a level sensor 660 mounted on the inside of the front 615 of the housing 610 which controls opening and closing of a valve 671 in the inlet pipe 639. The concentrated detergent solution may be directed from the housing 610 as desired by opening and closing a valve 672 in the outlet pipe 618 which extends from the bottom 612 of the housing 610.

Because only the downward facing portion of the solid cast block of detergent composition 300*s* is contacted and dissolved by the water, the solid cast block of detergent composition 300*s* should be rotated 180° about the central shaft 90 between each dispensing cycle to provide uniform dissolution. A means for rotating the solid cast block of detergent composition 300*s* is mounted on the right side 613 of the housing 610. The rotational drive assembly 640 includes a motor 641, a first gear 642 mounted onto the drive shaft (unnumbered) of the motor 641, a second gear 643 fixedly attached to the first end 91 of the central shaft 90, and a chain 644 interconnecting the first 642 and second 643 gears. The solid cast block of detergent composition 300*s* need only be rotated between dispensing cycles after the concentrated detergent solution has been directed from the dispenser 600 and the solid cast block of detergent composition 300*s* is no longer submerged.

Operation

Spray-Type

The solid cast block of detergent composition 300*s* may be dispensed from the spray-type dispensing system 500 depicted in FIGS. 6 and 7 by (i) placing a bushing 520 onto each of the first 91 and second 92 exposed ends of the central shaft 90 on the solid cast block of detergent composition 300*s*, (ii) securing an annular gear 543 onto the first end 91 of the central shaft 90 such that rotation of the annular gear 543 effects rotation of the central shaft 90, (iii) positioning the solid cast block of detergent composition 300*s* within the dispensing chamber 510*c* defined by the housing 510 with the bushings 550 previously placed onto the ends 91,92 of the central shaft 90 retained within the laterally aligned semicircular notches 517 in the right 513 and left 514 sides of the housing 510, (iv) closing the cover 520 to completely enclose the solid cast block of detergent composition 300*s* within the dispensing chamber 510*c* and sandwich the bushings 550 between the cover 520 and the housing 510 within orifices (unnumbered) defined by a combination of the semicircular notches 517 and 527 in the right 513,523 and left 514,524 sides of the housing 510 and cover 520, respectively, (v) linking the annular gear 543 coupled to the central shaft 90 to the drive gear 542 mounted upon the drive shaft (unnumbered) of the motor 541 with chain 544, (vi) spraying the solid cast block of detergent composition 300*s* with a dissolving solvent sprayed through the spray nozzle 530 so as to dissolve a portion of the solid cast block of detergent composition 300*s* and form a concentrated detergent solution (not shown), (vii) rotating the solid cast block of detergent composition 300*s* during spraying to provide a uniform dissolution of the solid cast block of detergent composition 300*s* across the entire surface area thereof, (viii) collecting the concentrated detergent solution within the dispensing chamber 510*c* defined by the housing 510, and (ix) directing the concentrated detergent solution from the dispensing chamber 510*c* through the exit orifice 518 in the bottom 512 of the housing 510 and on to a use location (not shown).

Submersion-Type

The solid cast block of detergent composition 300*s* may be dispensed from the submersion-type dispensing system 600 depicted in FIGS. 8 and 9 by (i) placing a bushing 650 onto each of the first 91 and second 92 exposed ends of the central shaft 90 on the solid cast block of detergent composition 300*s*, (ii) securing an annular gear 643 onto the first end 91 of the central shaft 90 such that rotation of the annular gear 643 effects rotation of the central shaft 90, (iii) positioning the solid cast block of detergent composition 300*s* within the dispensing chamber 610*c* defined by the housing 610 with the bushings 650 previously placed onto the ends 91,92 of the central shaft 90 retained within the laterally aligned semicircular notches 617 in the right 613 and left 614 sides of the housing 610, (iv) closing the cover 620 to completely enclose the solid cast block of detergent composition 300*s* within the dispensing chamber 610*c* and sandwich the bushings 650 between the cover 620 and the housing 610 within orifices (unnumbered) defined by a combination of the semicircular notches 617 and 627 in the right 613,623 and left 614,624 sides of the housing 610 and cover 620, respectively, (v) linking the annular gear 643 coupled to the central shaft 90 to the drive gear 642 mounted upon the drive shaft (unnumbered) of the motor 641 with chain 644, (vi) opening the valve 671 in the inlet pipe 630 to permit fluid flow into the dispensing chamber 610*c* from a source of pressurized fluid (not shown) through the inlet pipe 630, (vii) closing the valve 671 in the inlet pipe 630 to prevent fluid flow into the dispensing chamber 610*c* from the pressurized source of fluid when a predefined level of fluid is present in the dispensing chamber 610*c*, (viii) permitting the fluid to contact the solid block of detergent composition 300*s* so as to dissolve a portion of the solid cast block of detergent composition 300*s* and form a concentrated detergent solution (not shown), (ix) opening the valve 672 in the outlet pipe 618 extending from the bottom 612 of the housing 610 so as to direct the concentrated detergent solution from the dispensing chamber 610*c* to a use location (not shown), and (ix) rotating the solid cast block of detergent composition 300*s* 180° in order to submerge the other half of the solid cast block of detergent composition 300*s* during the next dispensing cycle.

I claim:

1. A method of dispensing a solid cast block of water-soluble detergent composition, comprising the steps of:

obtaining an article of commerce comprising at least twenty liters of a solid detergent composition cast onto a longitudinally extending structural core wherein the solid cast detergent composition defines an exposed surface area;

obtaining a spray-type dispenser having a spray chamber and a spray nozzle directed into the spray chamber;

placing the article of commerce within the spray chamber of the dispenser such that the solid detergent composition is suspended within the spray chamber upon the structural core which is in contact with the dispenser;

rotating the article of commerce within the spray chamber about the structural core;

spraying a dissolving solvent through the spray nozzle and into contact with the exposed surface area of the rotating detergent composition so as to dissolve a portion of the detergent composition and form a use solution of the detergent composition; and directing the use solution out of the dispenser and to an end use point substantially immediately after formation of the use solution.

2. The method of claim 1 wherein the solid cast detergent composition has a plurality of longitudinally extending passageways projecting completely through the solid cast block of detergent composition.

3. The process of claim 1 wherein the article of commerce includes at least 50 liters of solid cast detergent composition.

4. The process of claim 1 wherein the article of commerce includes at least 100 liters of solid cast detergent composition.

5. The process of claim 1 wherein the article of commerce includes at least 500 liters of solid cast detergent composition.

6. The process of claim 1 wherein the article of commerce is rotated by means of a motorized gear linkage in communication with the structural core.

7. The process of claim 1 wherein the dissolving solvent is water.

* * * * *

UNITED STATES PATENT AND TRADEMARK OFFICE

CERTIFICATE OF CORRECTION

PATENT NO. : 5,310,430

DATED : May 10, 1994

INVENTOR(S) : John E. McCall, Jr.

It is certified that error appears in the above-identified patent and that said Letters Patent is hereby corrected as shown below:

On column 2, line 63, please insert --a-- after the word "is"

On column 3, line 1, please insert --a-- after the word "is"

On column 3, line 67, please insert --conduits-- after the word "fifth"

On column 10, line 28, please delete "submerse" and substitute therefore --submerge--

Signed and Sealed this

Twentieth Day of September, 1994

*Attest:*

Bruce Lehman

BRUCE LEHMAN

*Attesting Officer*

*Commissioner of Patents and Trademarks*